US007749602B2

(12) United States Patent
Chu et al.

(10) Patent No.: US 7,749,602 B2
(45) Date of Patent: Jul. 6, 2010

(54) SURFACE-FINISHED YARN HAVING MULTIPLE INORGANIC MATERIALS

(75) Inventors: Chia-Lung Chu, Tu-Chen (TW); Huan-Jung Tai, Tu-Chen (TW); Jian-Min Lin, Benchiao (TW); Han-Hsing Hsiung, Hsinfeng Hsiang (TW)

(73) Assignee: Taiwan Textile Research Institute, Tu-Chen, Taipei Hsien (TW)

( * ) Notice: Subject to any disclaimer, the term of this patent is extended or adjusted under 35 U.S.C. 154(b) by 313 days.

(21) Appl. No.: 11/967,543

(22) Filed: Dec. 31, 2007

(65) Prior Publication Data

US 2008/0168759 A1 Jul. 17, 2008

(30) Foreign Application Priority Data

Jan. 16, 2007 (TW) ..... 96101653 A

(51) Int. Cl.
*D02G 3/00* (2006.01)

(52) U.S. Cl. ..... 428/370; 428/194; 428/195.1; 428/377; 428/378; 428/379; 442/230; 442/317

(58) Field of Classification Search ..... 428/194, 428/195.1, 378, 370, 377, 379; 57/200; 442/230, 442/317; 174/110 R, 120 R
See application file for complete search history.

(56) References Cited

U.S. PATENT DOCUMENTS

| | | | | |
|---|---|---|---|---|
| 4,042,737 | A * | 8/1977 | Forsgren et al. | 428/96 |
| 6,815,061 | B2 * | 11/2004 | Van Heerden et al. | 428/370 |
| 2006/0134390 | A1 * | 6/2006 | Lin et al. | 428/194 |

* cited by examiner

*Primary Examiner*—N. Edwards
(74) *Attorney, Agent, or Firm*—Thomas, Kayden, Horstemeyer & Risley

(57) ABSTRACT

A surface-finished yarn having multiple inorganic materials is provided. The surface-finished yarn comprises a yarn, a first material and a second material. The surface of the yarn comprises a plurality of the plurality of first regions and a plurality of second regions wherein the plurality of first regions and the plurality of second regions are alternately disposed along an axial direction of the yarn. The first material is disposed onto the plurality of first regions while the second material different from the first material is disposed onto the plurality of second regions.

21 Claims, 2 Drawing Sheets

SURFACE-FINISHED YARN HAVING MULTIPLE INORGANIC MATERIALS

RELATED APPLICATIONS

This application claims priority to Taiwan Application Serial Number 96101653, filed Jan. 16, 2007, which is herein incorporated by reference.

BACKGROUND

1. Field of Invention

The present invention relates to a surface-finished yarn. More particularly, the present invention relates to a surface-finished yarn having multiple inorganic materials.

2. Description of Related Art

Fabrics have been widely applied in our everyday lives. In addition to clothing, fabrics can also be used as a foundation for supporting wound dressing, dishcloth and different types of wipers. As the advance of the technology, the functions of the fabrics are not limited to thermal protection, and manufacturers are trying to produce yarn with additional functions so as to increase the value of the fabrics thereof. Therefore, it is desired to provide a novel multi-functional yarn and/or fabric.

SUMMARY

A surface-finished yarn having multiple inorganic materials and a fabric thereof are provided in the present invention.

According to one embodiment of the present invention, a surface-finished yarn having multiple inorganic materials is provided. The surface-finished yarn comprises a yarn, a first material and a second material. The surface of the yarn comprises a plurality of first regions and a plurality of second regions wherein the plurality of first regions and the plurality of second regions are alternately arranged on the yarn along an axial direction thereof. The first material is disposed onto the plurality of first regions while the second material different from the first material is disposed onto the plurality of second regions.

According to another embodiment of the present invention, a fabric having multiple inorganic materials is provided. The fabric comprises a surface-finished yarn of the previous embodiment and a common yarn. The common yarn and the surface-finished yarn are cowoven to form the fabric with multiple inorganic materials.

According to yet another embodiment of the present invention, a surface-finished yarn having multiple inorganic materials is provided. The surface of the surface-finished yarn is deposited with a first material and a second material. The surface-finished yarn is obtained by deknitting a single-woven fabric wherein a first material and a second material are deposited onto the upper surface and the lower surface, respectively.

According to yet another embodiment of the present invention, a fabric having multiple inorganic materials is provided. The fabric comprises a surface-finished yarn of the previous embodiment and a common yarn. The common yarn and surface-finished yarn are cowoven to form the fabric with multiple inorganic materials.

According to the present invention, the surface-finished yarn having multiple inorganic materials and the fabric thereof exhibit not only the characteristics of the original yarn and the fabric but also the functions imposed by the inorganic materials deposited thereon, thus provide additional functions to the surface-finished yarn and the fabric thereof.

BRIEF DESCRIPTION OF THE DRAWINGS

The invention can be more fully understood by reading the following detailed description of the embodiment, with reference made to the accompanying drawings as follows.

DETAILED DESCRIPTION

Reference will now be made in detail to the present embodiments of the invention, examples of which are illustrated in the accompanying drawings.

A Surface-Finished Yarn Having Multiple Inorganic Materials

Figure 1:
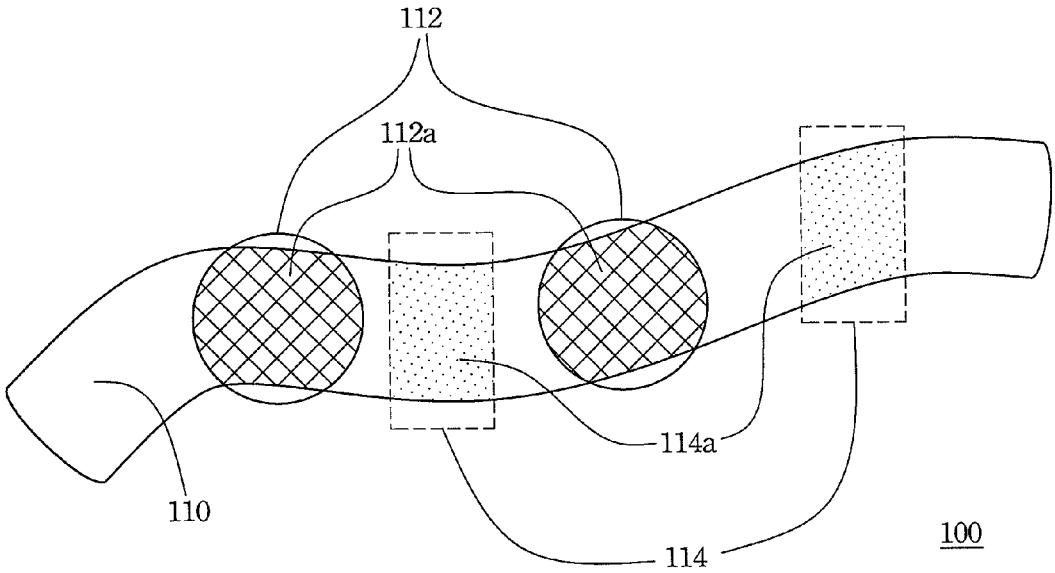
FIG. 1 is a diagram illustrating a surface-finished yarn having multiple inorganic materials according to one embodiment of the present invention.

Refer to FIG. 1, FIG. 1 is a diagram illustrating a surface-finished yarn having multiple inorganic materials according to one embodiment of the present invention. The surface-finished yarn 100 comprises a yarn 110, a first material 112*a* and a second material 114*a*, wherein the plurality of first regions 112 and the plurality of second regions 114 are alternately arranged on the yarn 110 along an axial direction thereof. The first material 112*a* is disposed onto the plurality of first regions 112 while the second material 114*a* different from the first material 112*a* is disposed onto the plurality of second regions 114.

Figure 2:
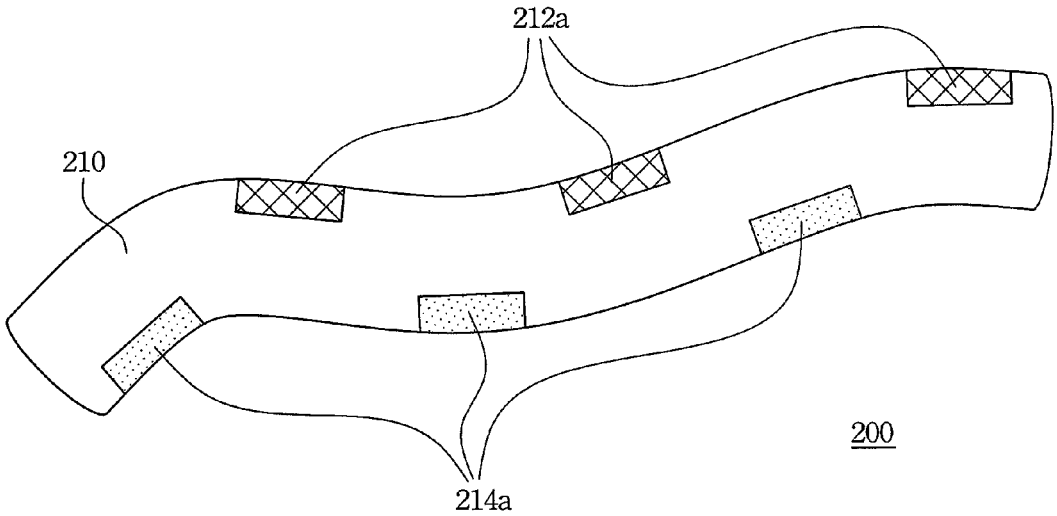
FIG. 2 is a diagram illustrating another aspect of a surface-finished yarn having multiple inorganic materials according to one embodiment of the present invention.

Refer to FIG. 2. FIG. 2 is a diagram illustrating another aspect of a surface-finished yarn having multiple inorganic materials according to one embodiment of the present invention. A first material 212*a* and a second material 214*a* of a surface-finished yarn 200 can be disposed onto the upper surface and the lower surface of the yarn 210 respectively, wherein the first material 212 and the second material 214 are alternately arranged on the yarn 210 along an axial direction thereof.

The weight ratio of the first material 112*a*, 212*a* to the second material 114*a*, 214*a* is 2:8~5:5. The weight percentage of the overall weight of the first material 112*a*, 212*a* and the second material 114*a*, 214*a* in the yarn 110, 210 is 0.001~20 wt %. Forming proper amounts of the first material 112*a* and the second material 114*a* by surface finishing allows the yarn 110 of the surface-finished yarn 100 to not only preserve its original properties but also exhibit the additional properties provided by the first material 112*a* and the second material 114*a*.

The above-mentioned first material 112*a* and second material 114*a* can be metal, metallic oxide, ceramic, or tourmaline. Table 1 exemplifies various inorganic materials of the above-mentioned categories and functions thereof.

TABLE 1

Functions Provided by Selected Inorganic Materials

| Material | Composition | function |
|---|---|---|
| Metal | Ag | anti-bacteria, anti-odor, thermal insulation, electric conductivity, anti-electrostatics |
| | Ti | Regulate body current |
| | Ge | generate ions |
| | Zn | anti-bacteria |
| | Ni | regulate electric potential |
| | Cu | regulate electric potential |
| | Combination of the above-mentioned metals | |
| Metallic oxide | $TiO_2$ | generate free radicals or ion radicals, decompose hazardous material |
| | TiO | generate ions |
| | $SnO_2$ | generate ions |
| | ZnO | generate far infra-red ray and ions |
| | $Al_2O_3$ | generate far infra-red ray |
| | $ZrO_2$ | high corrosion resistance, high thermal resistance, high abrasive resistance, electric, magnetic property |
| | Combination of the above-mentioned metallic oxides | |
| Ceramic | $SiO_2$ | high corrosion resistance, high thermal resistance, high abrasive resistance, electric, magnetic, photo, heat property |
| | Barium Titanate | high corrosion resistance, high thermal resistance, high abrasive resistance, electric, magnetic property |
| | PZT (Lead Zirconate Titanate) | high corrosion resistance, high thermal resistance, high abrasive resistance, electric, magnetic property |
| | SiC | high corrosion resistance, high thermal resistance, high abrasive resistance, high toughness |
| | SiN | high corrosion resistance, high thermal resistance, high abrasive resistance, high toughness |
| | Combination of the above-mentioned ceramics | |
| | tourmaline | generate ions |

Figure 3:
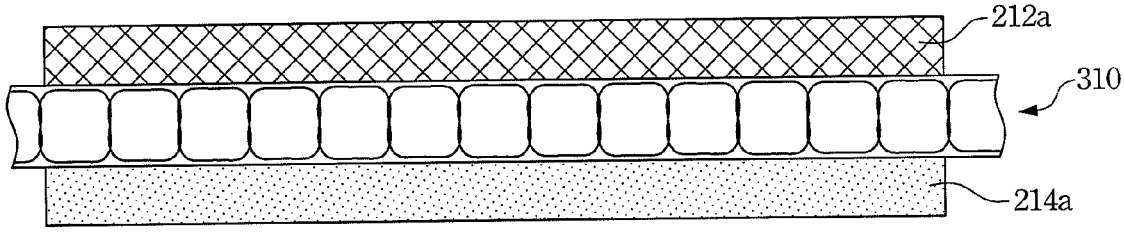
FIG. 3 is a cross sectional view illustrating a fabric of the present invention.

A Method for Manufacturing Surface-Finished Yarn Having Multiple Inorganic Materials The surface-finished yarn 200 in FIG. 2 is used to demonstrate its manufacturing process. Refer to FIG. 3, FIG. 3 is a cross sectional view illustrating a fabric. A first material 212*a* and a second material 214*a* different from the first material 212*a* are deposited onto the upper and the lower surfaces of the fabric 310 respectively. Then, the fabric 310 is deknitted so as to form the surface-finished yarn 210 shown in FIG. 2.

The above-mentioned deposition method can be, for example, physical vapor deposition, wherein a first material source and a second material source can be arranged on the upper and the lower surface of the fabric 310 respectively such that the first material 212*a* and the second material 214*a* can be deposited onto the upper and the lower surfaces of the fabric 310 by a sputtering method respectively. More specifically, the first material 212*a* and the second material 214*a* can be deposited onto the upper and the lower surfaces of the fabric 310 respectively at the same time.

Ag/Ti Surface-Finished Yarn and Fabric Thereof

The above-mentioned surface-finished yarn 100, 200 can be woven alone or cowoven with a common yarn without inorganic material, thereby forming fabrics having multiple inorganic materials. The fabric of this embodiment can exhibit additional functions provided by the inorganic materials.

According to the above-mentioned embodiments, the Ag target and the Ti target are used as the first material source and the second material source respectively for manufacturing the Ag/Ti surface-finished yarn. The sputtering conditions for metallic Ag and Ti are shown in Table 2.

TABLE 2

Sputtering Conditions of Ag and Ti.

| | | Sputtering condition | | | | | |
|---|---|---|---|---|---|---|---|
| Material | Composition | Sputtering method | Background pressure (Torr) | Process pressure (Torr) | Sputtering power (W) | Transfer speed (cm/s) | gas |
| metal | Ag | DC sputtering | $8.5 \times 10^{-6}$ | $3.5 \times 10^{-5}$ | 50 | 3 | Ar |
| | | | $7.0 \times 10^{-5}$ | $2.0 \times 10^{-3}$ | 800 | 10 | Ar |
| | | | $5.5 \times 10^{-2}$ | $5.5 \times 10^{-2}$ | 10000 | 50 | Ar |

TABLE 2-continued

Sputtering Conditions of Ag and Ti.

| Material | Composition | Sputtering method | Sputtering condition: Background pressure (Torr) | Process pressure (Torr) | Sputtering power (W) | Transfer speed (cm/s) | gas |
|---|---|---|---|---|---|---|---|
| | Ti | DC sputtering | $8.5 \times 10^{-6}$ | $3.5 \times 10^{-5}$ | 60 | 3 | Ar |
| | | | $7.0 \times 10^{-5}$ | $2.0 \times 10^{-3}$ | 300 | 10 | Ar |
| | | | $5.5 \times 10^{-2}$ | $5.5 \times 10^{-2}$ | 7000 | 50 | Ar |

In Table 2, "supttering power" is the power required to ionize the gas (plasmarization), "transfer speed" is the speed that the fabric passes through the sputtering target for sputtering, "background pressure" is the pressure of the vacuumed sputtering chamber (vacuum degree) before the sputtering process, and "process pressure" is the pressure of the sputtering chamber during the sputtering process.

After the above-mentioned Ag/Ti surface-finished yarn has been obtained, the Ag/Ti surface-finished yarn can be woven alone or cowoven with a common yarn thereby forming a fabric for further performance test. The surface-finished yarn and the common yarn are made of polyethylene terephthalate (PET) so that a PET cloth can be formed. The weight ratio of Ag to Ti of the PET cloth is 2:1, and the weight percentage of Ag and Ti in the PET cloth is 6%.

Table 3 shows the test results of the human test of the Ag/Ti PET cloth. Table 4 shows the anti-bacteria test results of the Ag/Ti PET cloth. The anti-bacteria test has been performed according to the test methods specified by American Association of Textile Chemists and Colorists (AATCC) and Japanese Industrial Standards Committee (JISC).

TABLE 3

Human Test of the Ag/Ti PET Cloth

| Test items | | Test results: Ag/Ti PET cloth (test sample) | Regular PET cloth (comparative sample) |
|---|---|---|---|
| Hand blood flow volume (cc/min) | before use | 40.7 | 40.9 |
| | use PET cloth for 20 min | 50.2 | 46.3 |
| | difference (%) | +23.3 | +13.2 |
| Hand blood flow velocity (cm/min) | before use | 9.2 | 9.2 |
| | use PET cloth for 20 min | 11.0 | 9.9 |
| | difference (%) | +19.6 | +7.6 |

TABLE 4

Anti-Bacteria Test of the Ag/Ti PET Cloth.

| Test items | Test results | Test methods |
|---|---|---|
| *Escherichia* | Anti-bacteria rate >99.88% | AATCC 100-2004 |
| *Pseudomonas aeruginosa* | Anti-bacteria rate >99.93% | AATCC 100-1999 |
| *Trichophyton mentagrophytes* | No bacteria growth on cloth surface | AATCC 100-1999 |
| *Pneumobacillus* | Anti-bacteria rate >82.38% | AATCC 100-1999 |
| *Candidaalbicans* | Anti-bacteria rate >99.90% | AATCC 100-1999 |
| *Staphylococcus aureus* | sterilizing value >3.1 | JIS L1902-1998 quantitative method |

Tests results shown in Table 3 and Table 4 indicate that the Ag/Ti PET cloth of the embodiment of the present invention is able to increase the hand blood volume and velocity, thus improve the blood circulation. In addition, Ag in the PET cloth possesses the anti-bacteria ability and can be used to kill bacteria covered by the PET cloth.

Sputtering of Other Materials

Table 5 shows the sputtering conditions of a metallic oxide, for example, $TiO_2$ and a ceramic, according to the embodiment of the present invention. It is also possible to form a metallic oxide or a ceramic on the surface-finished yarn by controlling the sputtering condition. For example, a surface-finished yarn having two metallic oxides such as $TiO_2/ZnO$ can be formed so as to provide functions of anti-bacteria, hazardous substances decomposition and ion generation at the same time. A surface-finished yarn having two ceramics such as $SiO_2/Al_2O_3$ can also be formed so as to provide functions of far infra-red radiation generation, thermal insulation, and UV protection.

TABLE 5

Sputtering Conditions of $TiO_2$ and $SiO_2$

| Material | Sputtering method | Sputtering condition: Sputtering method | Background pressure (Torr) | Process pressure (Torr) | Sputtering power (W) | Transfer speed (cm/s) |
|---|---|---|---|---|---|---|
| $TiO_2$ | RF sputtering | $8.0 \times 10^{-6}$ | $4.0 \times 10^{-5}$ | 80 | 1 cm/s | Ar |
| | | $5.0 \times 10^{-4}$ | $7.0 \times 10^{-3}$ | 3000 | 15 cm/s | Ar |
| | | $3.5 \times 10^{-2}$ | $2.0 \times 10^{-2}$ | 8000 | 30 cm/s | Ar |
| $SiO_2$ | RF sputtering | $4.3 \times 10^{-6}$ | $3.5 \times 10^{-5}$ | 50 | 0.16 cm/s | Ar |
| | | $7.5 \times 10^{-4}$ | $1.5 \times 10^{-5}$ | 5000 | 10 cm/s | Ar |
| | | $5.5 \times 10^{-2}$ | $4.5 \times 10^{-2}$ | 10000 | 20 cm/s | Ar |

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A surface-finished yarn with multiple inorganic materials, comprising:

a yarn, wherein a surface of the yarn comprises a plurality of first regions and a plurality of second regions, wherein the plurality of first regions and the plurality of second regions are alternately arranged on the yarn along an axial direction thereof;

a first material disposed onto the plurality of first regions; and a second material disposed onto the plurality of second regions, wherein the second material is different from the first material, wherein a weight percentage of an overall weight of the first material and the second material to the yarn is 0.001~20 wt %.

2. The surface-finished yarn with multiple inorganic materials of claim 1, wherein the weight ratio of the first material to the second material is 2:8~5:5.

3. The surface-finished yarn with multiple inorganic materials of claim 1, wherein the first material and the second material are selected from the group consisting of metal, metallic oxide, and ceramic respectively.

4. The surface-finished yarn with multiple inorganic materials of claim 1, wherein the first material or the second material is tourmaline.

5. The surface-finished yarn with multiple inorganic materials of claim 3, wherein the metal material is selected from the group consisting of Ag, Ti, Ge, Zn, Cu and a combination thereof.

6. The surface-finished yarn with multiple inorganic materials of claim 3, wherein the metallic oxide is selected from the group consisting of $TiO_2$, TiO, $SnO_2$, ZnO, $Al_2O_3$, $ZrO_2$ and a combination thereof.

7. The surface-finished yarn with multiple inorganic materials of claim 3, wherein the ceramic is selected from the group consisting of $SiO_2$, Barium Titanate, SiN, SiC, Lead Zirconate Titanate and a combination thereof.

8. The surface-finished yarn with multiple inorganic materials of claim 1, wherein the first material and the second material are Ag and Ti respectively, thereby forming the surface-finished yarn for improving blood circulation and antibacteria function.

9. A surface-finished yarn with multiple inorganic materials, comprising a first material and a second material different from the first material are deposited thereon, wherein the surface-finished yarn is obtained by deknitting a single-woven fabric, wherein the first material and the second material are deposited on an upper surface and a lower surface thereof respectively.

10. The surface-finished yarn with multiple inorganic materials of claim 9, wherein the first material from a first material source and the second material from a second material source are deposited onto the upper surface and the lower surface of the fabric by a sputtering method respectively.

11. The surface-finished yarn with multiple inorganic materials of claim 9, wherein the first material and the second material are deposited onto the upper surface and the lower surface of the fabric respectively at the same time.

12. The surface-finished yarn with multiple inorganic materials of claim 9, wherein the weight percentage of an overall weight of the first material and the second material in the fabric is 0.001~20 wt %.

13. The surface-finished yarn with multiple inorganic materials of claim 9, wherein the weight ratio of the first material to the second material is 2:8~5:5.

14. The surface-finished yarn with multiple inorganic materials of claim 9, wherein the first material and the second material are selected from the group consisting of metal, metallic oxide, and ceramic respectively.

15. The surface-finished yarn with multiple inorganic materials of claim 9, wherein the first material or the second material is tourmaline.

16. The surface-finished yarn with multiple inorganic materials of claim 14, wherein the metal material is selected from the group consisting of Ag, Ti, Ge, Zn, Cu and a combination thereof.

17. The surface-finished yarn with multiple inorganic materials of claim 14, wherein the metallic oxide is selected from the group consisting of $TiO_2$, TiO, $SnO_2$, ZnO, $Al_2O_3$, $ZrO_2$ and a combination thereof.

18. The surface-finished yarn with multiple inorganic materials of claim 14, wherein the ceramic is selected from the group consisting of $SiO_2$, Barium Titanate, SiN, SiC, Lead Zirconate Titanate and a combination thereof.

19. The surface-finished yarn with multiple inorganic materials of claim 9, wherein the first material and the second material are Ag and Ti respectively, thereby forming the surface-finished yarn for improving blood circulation and antibacteria function.

20. A fabric with multiple inorganic materials, comprising:

a surface-finished yarn of any one of the claims 1, and 2-8; and a common yarn, wherein the common yarn and the surface-finished yarn are cowoven thereby forming a fabric with multiple inorganic materials.

21. A fabric with multiple inorganic materials, comprising:

a surface-finished yarn of any one of the claims 9~19; and a common yarn, wherein the common yarn and the surface-finished yarn are cowoven thereby forming a fabric with multiple inorganic materials.

* * * * *